US005251706A

United States Patent [19]

Evans

[11] Patent Number: 5,251,706

[45] Date of Patent: Oct. 12, 1993

[54] RATCHET DRIVE TOOL WITH MANUAL AND NON-MANUAL POWER ACTUATION

[76] Inventor: Jack Evans, 5515 Bent Green, Dallas, Tex. 75248

[21] Appl. No.: 984,967

[22] Filed: Dec. 3, 1992

[51] Int. Cl.[5] ..... B25B 21/00

[52] U.S. Cl. ..... 173/29; 173/217; 81/177.7; 81/57.26

[58] Field of Search ..... 81/177.7, 177.8, 177.9, 81/57.26, 57.29; 173/213, 217, 221, 218, 164, 29

[56] References Cited

U.S. PATENT DOCUMENTS

| | | | |
|---|---|---|---|
| 3,733,935 | 5/1973 | Tsuji | 173/218 X |
| 3,733,936 | 5/1973 | Flynn | 81/57.29 X |
| 4,170,909 | 10/1979 | Wagner | 81/177.7 X |
| 4,912,349 | 3/1990 | Chang | 173/217 X |
| 4,993,288 | 2/1991 | Anderson | 81/177.9 X |

*Primary Examiner*—Frank T. Yosi
*Assistant Examiner*—Rinaldi Rada
*Attorney, Agent, or Firm*—Michael G. Berkman

[57] ABSTRACT

A ratchet nut runner is energized either manually or by a non-manual power source such as a battery, on-line electrical power or a pneumatic supply. A tubular body or housing, which contains speed-reducing and power-amplifying structures, serves also as the handle or hand grip for the device. A driven drive shaft which extends coaxially from the housing is connected to a head of the device through a pivot joint assembly. An important feature of the drive device is that the housing-enclosed drive shaft is pivotable from a non-manual power drive mode in which the drive shaft is coaxial with a tool-engaging stud or coupler, to a configuration in which the drive shaft extends normally of the coupler for rotation of the drive head manually. A switch which connects non-manual power to the drive shaft operates to cut off power when the device is disposed in a manual mode of operation.

8 Claims, 2 Drawing Sheets

RATCHET DRIVE TOOL WITH MANUAL AND NON-MANUAL POWER ACTUATION

BACKGROUND AND FIELD OF THE INVENTION

The present invention relates to a ratchet drive tool of the type using a drive stud for coupling with any of a series of selectable sockets or other workpiece-engaging elements. More particularly, the invention is directed to a drive wrench energized by a non-manual power supply but which may also be safely and effectively used manually.

Drive wrenches which are energized electrically, using batteries or line current supplies, are known in the art. Wrenches such as air-driven impact wrenches using non-manual power such as compressed air and similar energy sources are also well known. For the most part such tools, which rely upon non-manual power source energization, cannot be used advantageously employing manual power alone.

Drive tools of the general type referred to above may incorporate universal joint mechanisms to facilitate ease of access to a bolt or a nut to be tightened or removed. In such devices the applied torque is directed through a drive component which is oriented essentially coaxially with the element of the tool to be driven. Any angle of deviation from an in-line disposition of driving and driven element is necessarily quite limited or restricted. No substantial deviation from coaxial alignment is ordinarily feasible, particularly in a simple arrangement of simple mechanical components. Again, such tools do not lend themselves to the use, optionally, of manual power as a substitute for a non-manual energy source.

Also known in the art are electrically energized tools, including battery driven nut drivers and related tools in which a driving stud or workpiece-engaging element or coupler of the wrench is axially in direct drive alignment with an elongate tool body or hand-gripped housing of the tool. While the body of such tools may be rotated by hand about its elongate axis, coaxially with the mode of rotation effected during battery driven operation, the torque which can be realized in such a manual operation is significantly limited. Such torquing forces which can be impressed by manually rotating the elongate tool are ordinarly insufficient either to breakloose a "frozen" bolt or nut or to tighten or lock fasteners to a required or desired degree of security. Manual rotation of the "shaft" of the tool about its axis is ineffective to develop the required torque.

It is, therefore, a principal aim of the present invention to provide a ratchet drive tool which may be used, optionally, with either non-manual power or manually and in which application of very substantial manual torquing force is feasible as a viable option and is achieved in a simple and effective manner.

SUMMARY OF THE INVENTION

The present invention provides a ratchet nut runner or driver having a drive mechanism which may be powered or actuated non-manually using air pressure (pneumatic forces), by means of an external electrical input, or by a battery. Alternatively and optionally, the drive tool may be effectively used manually. The tool itself includes a drive stud or a socket-coupling element or other component for engaging a workpiece to be acted upon, a drive head including a ratchet mechanism, and a pivot joint or coupling connecting the wrench head to an elongate body of the wrench. The wrench body serves as a housing for the drive shaft and for a power transfer and enhancing system.

In a preferred embodiment of the invention there is provided speed reducing and power increasing gears and gear assemblies, with a battery as a power source. Other embodiments of the invention may use an external or a line supply electrical power source. Alternatively, a pneumatic source of tool-energizing power may be employed.

An important feature of each embodiment of the drive wrench of the invention is that the handle component or hand-held housing for the drive shaft and other component of the tool may be shifted, at the pivot joint, to extend at an angle of 90° with respect to the rotational shaft of the drive stud or workpiece coupler. The tool handle or elongate body may then itself be used, manually, as a final (or as an initial) rotating force-generating or tool-driving element.

A related feature which facilitates the effective use of the drive wrench manually is the provision of a drive head which includes a ratchet mechanism.

A critical feature of the tool of the present invention is the provision of a mechanism which ensures a positive disconnection decoupling between the non-manual power source and the drive head of the tool when the body housing or drive shaft of the tool is pivoted with respect to the tool head to establish a manual drive mode of the tool.

In some preferred embodiments of the driver tool of the invention an electrical power supply is used as the tool-energizing source. In these embodiments of the tool, pivotal swinging of the tool housing or drive shaft to a 90° angle with respect to the rotating axis of the drive stud or coupler is effective physically to open an electrical switch in the body of the housing, so as to cut off all electrical power to the drive head of the wrench. Thus, a high degree of safety during manual operation of the wrench is assured.

A related important feature of the present invention is that in embodiments of the wrench which rely on a pneumatic source for driving power, pivoting the wrench body and drive shaft 90° with respect to an axis of rotation of the drive stud to establish a manual use mode of the drive tool operates to close a gate in the pressurized gas delivery system, thereby preventing compressed driving gas from acting on the pneumatic drive mechanism of the tool.

It is a feature of a preferred embodiment of the invention that in the manual drive mode of the tool, the spatial orientation assumed by the wrench components, including the body or drive shaft and the drive head or drive stud is such as to ensure a maximum moment or advantage for the tool. That is, the axis of the manually-manipulated body of the wrench extends to revolve in a plane normal to an axis of rotation of the tool-engaging drive stud. Arcuate displacement of the wrench handle or wrench body impresses maximized rotative force moments against the drive stud or coupler.

A feature of the mechanism of the drive wrench of the invention is that as those portions of the wrench which are pivotally connected by the pivot joint are manipulated relative to one another to establish mutually perpendicular orientational modes of the handle member with respect to the drive stud or drive end of the wrench, a camming force is impressed upon a spring-biased sleeve. The sleeve is displaced longitudinally along an axial direction of the tool body forcibly to effect an opening of an electrical junction, thus cutting off electrical power to the drive system of the wrench.

Yet another feature of the drive wrench of the invention is that it includes selectively operable electrical control switch mechanisms for turning electrical power "on" and "off", and also for effecting drive shaft rotation in each of two opposed annular operational directions.

In one preferred embodiment of the invention a coil spring encircles the drive shaft of the wrench in a forward zone. The spring is resiliently restrained in an annular cavity and stressingly urges a reciprocally shiftable sleeve to a forward position to establish a non-manual operative drive mode. Camming action of a pivotal component of the pivot joint when the wrench is converted to a manual operating mode effects a forced longitudinal displacement of the spring-biased sleeve rearwardly to open electrical contacts, thus interrupting delivery of electrical power to the internal driving mechanism of the wrench.

It is a feature of the embodiment of the drive wrench depicted in the drawings that electrical power is supplied by a battery which is received and removably secured in a rearwardly opening longitudinal chamber of the body of the wrench.

In an alternative mode of energization of the drive tool, electrical input is derived from a line supply. The tool of the invention includes a recessed male electrical plug to which a suitable extension cord delivering electrical power from a line supply may be connected.

Other and further objects, features and advantages of the invention will be understood upon a reading of the following detailed description considered in conjunction with the drawings.

DETAILED DESCRIPTION OF ILLUSTRATED EMBODIMENT

Figure 1:
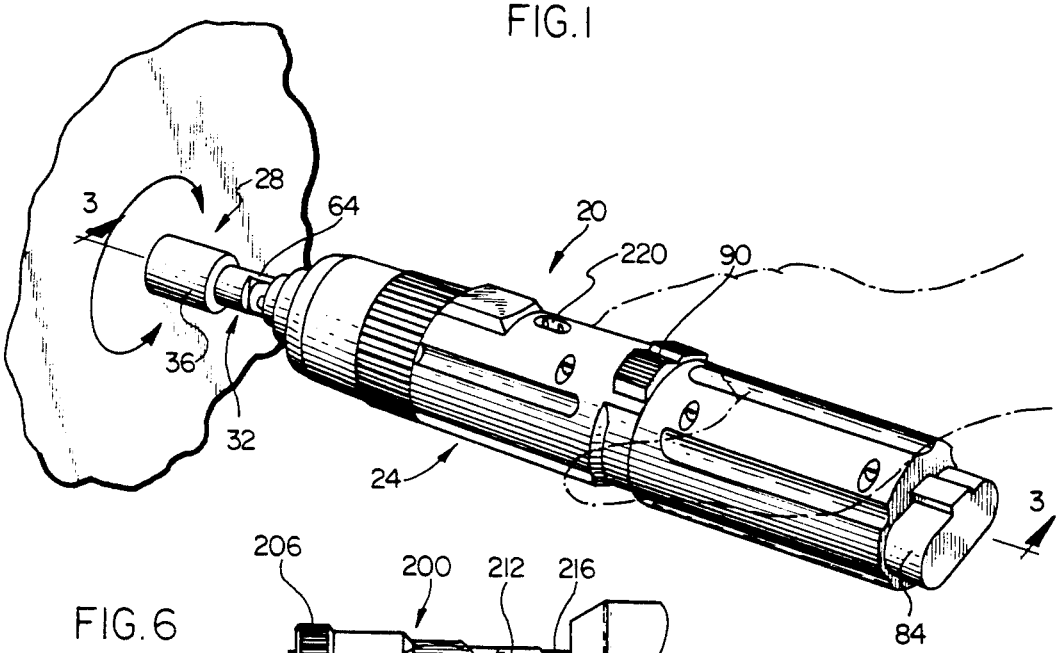
FIG. 1 is a side perspective of a ratchet drive nut runner embodying features of the present invention and indicating schematically the mode of manipulation and use when employing non-manual power means.

The aims and objects of the present invention are achieved, in accordance with the practice of the invention, by providing, in a nut driver or wrench, the capability of effective operation using either non-manual or manual power. The tool of the invention is characterized in that it exhibits a high level of rotative torque even when energized by a self-contained battery. Optionally, the tool may be powered from a line electric source or from a pneumatic supply of the type used to energize or drive impact wrenches.

The versatility of the tool of the invention is evidenced by the fact that it may be employed exceeding effectively manually. The manual force readily impressible is adequate to break loose "frozen" or otherwise stubborn or resistant nuts or bolts, etc. or, alternatively to effect any desired degree of final securement or tightening. A feature of the invention is that the elongate body of the wrench is pivoted to become a manually rotatable torquing lever to impress high torquing moments on the workpiece to which the tool is operationally coupled.

Referring now to the drawings, and particularly to FIGS. 1–5, there is shown, for illustrative purposes and not in any limiting sense, a preferred embodiment of the tool of the invention incorporating the features thereof.

In the specific example of the invention depicted, a nut driver tool 20 is shown as an assembled structure including an elongate housing 24 connected to drive head 28 through a pivot joint assembly 32. In the embodiment of the invention shown in FIGS. 1–5 the drive head 28 includes a non-circular stud or coupler 34 for driving by connecting to an article to be turned, including a drive socket, or other tool element 36 having a mating opening 40, for accommodating the drive stud 34. The drive socket 36 is selectible to engage a nut, bolt head, screw or other workpiece or work-receiving member.

Figure 2:
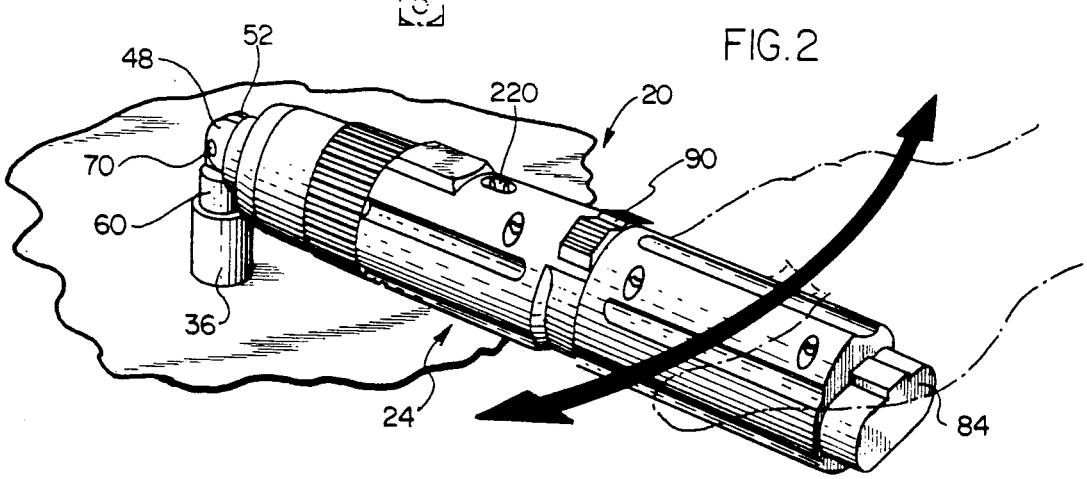
FIG. 2 is a view similar to FIG. 1 but with the workpiece engaging drive stud directed normally of the drive shaft and depicting a manual mode of powering the drive tool.

The pivot joint 32 is shown in FIGS. 1 and 2 as including a bifurcated or forked coupler component defining a pair of projecting spaced parallel arms 48 and 52 preferably of rectangular cross section and having aligned transverse openings 54. The arms 48 and 52 of the pivot joint are integrally formed as extensions of a drive shaft 56 of the driver tool. The drive shaft 56 is coaxial with the housing 24 of the tool 20 and extends therefrom. As shown in FIGS. 1–5, the body 60 of the drive head 28 of the driver tool 20 is formed, at its end opposed to the stud 24 with a joint member or connecting bar 64 rectangular in cross section and slightly smaller in width than the separation of the arms 48 and 52 of the pivot joint 32. The bar 64 is formed with a transverse bore 66 for alignment with the openings 54 in the arms 48 and 52 to receive a pivot pin 70 therethrough.

Figure 3:
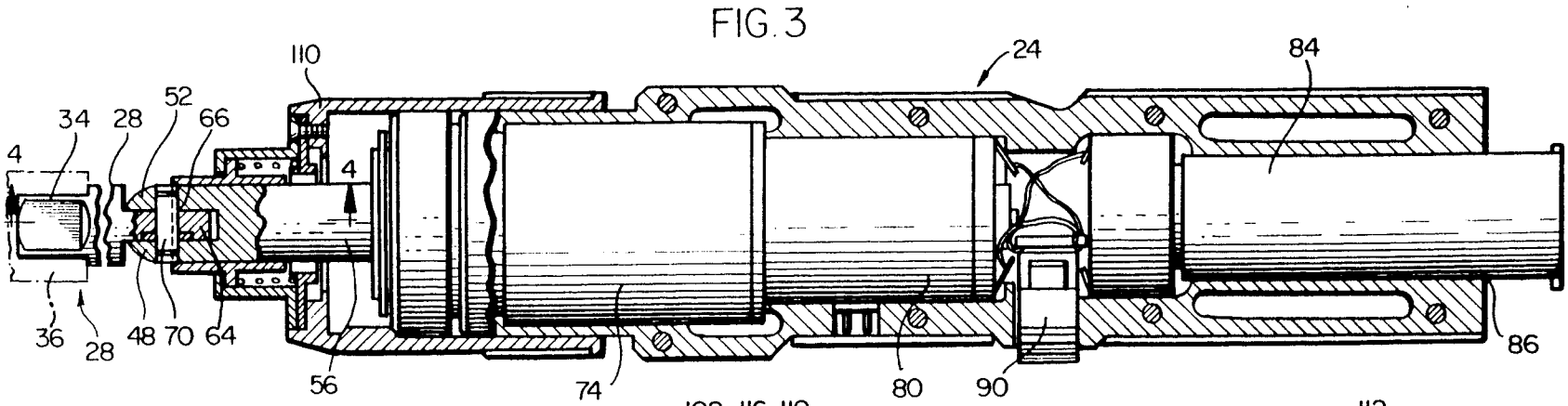
FIG. 3 is a cross-sectional view of one embodiment of a ratchet drive tool, according to the invention, and showing the arrangement of operational components including a hand-grip housing containing a power supply, drive gearing and speed reducing and power amplifying gear assemblies, a drive shaft, and a drive head including a pivotally connected coupler assembly and terminating in a workpiece-engaging tool element.

Referring now more particularly to FIG. 3, the housing 24 is shown, schematically, as including speed-reducing and power amplifying gears and related components 74 to which the drive shaft 56 of the tool is connected. Speed-reducing and power-amplifying gear trains and drive assemblies are well known in the art. Any such structures, as found in power screw drivers and low speed electric drills, are incorporated herein by reference and may be readily adapted for use in the present invention, without exercise of the inventive faculty.

The speed-reduced, high-power drive system 74 for rotating the drive shaft 56 is powered, as shown schematically in FIG. 3, by an electric motor 80. The motor 80, in the embodiment of the invention illustrated, is powered by a battery 84 slidably received and retained in a chamber 84 at a rear of the housing 23 and opening 86 endwise. The precise internal construction of the battery 84 and its chemical composition constitute no part of the present invention. Many batteries suitable for powering the drive system of the tool of the present invention are known in the relevant art. No specific additional description is deemed necessary.

As further shown in FIG. 3, a three-position slide switch 90 is interposed in series electrical connection, between the battery 84 and the drive motor 80. Functional setting positions for the switch include OFF, forward drive, F, and reverse drive, R.

An important feature of the drive wrench 20 of the invention is the manner in which it can be used manually, and with substantial rotary force to impress high force moments. Invoking this capability, initial loosening and final tightening of nuts, bolts and screws, etc., may be easily and conveniently carried out. To effectuate the manual procedure described, the elongate body or housing 24 of the wrench 20 is pivoted at the pivot joint 32 about the pivot pin 70 to assume a position normal to the body 60 of the drive head 28, as indicated in FIG. 2. The housing may then be manually rotated about the axis of the drive head body 60 to impress rotational force in the stud 34 and on any work-receiving member or workpiece 36 to which the tool 20 is coupled.

The present invention is characterized in that it includes unique mechanical structures which contribute to and ensure a high degree of safety in operation. The user of the tool 20 is afforded valuable protection against physical injury. A critical feature of the tool assembly 20 of the invention is that upon pivotal manipulation of the tool body or housing 24 to extending normally of the body 60 of the drive head 28 of the drive wrench 20, electrical connection to the drive shaft 56 of the tool 20 is positively severed.

Figure 5:
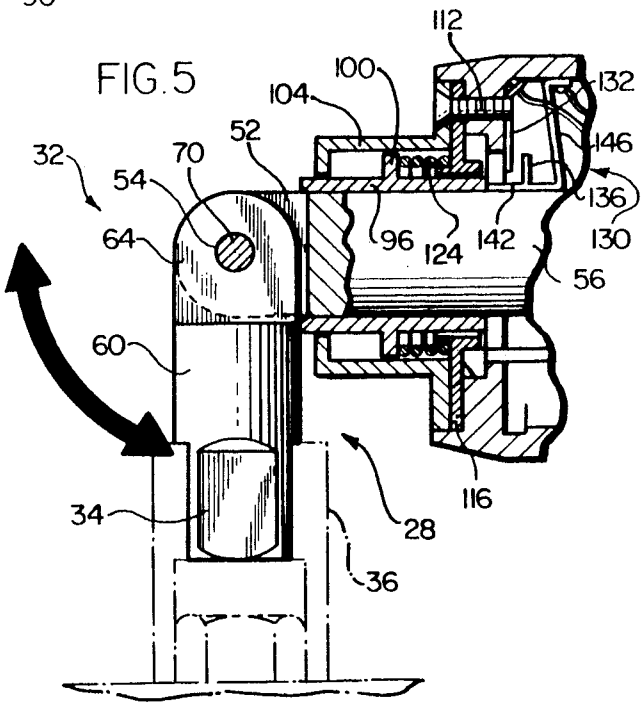
FIG. 5 is an enlarged, fragmentary view similar to that of FIG. 4, but with the drive head of the tool pivoted 90° to effect, through cam action sleeve displacement, an opening of an internal switch to cut off power delivery to the drive head of the tool, thus transforming the tool into a manual drive mode.
Figure 4:
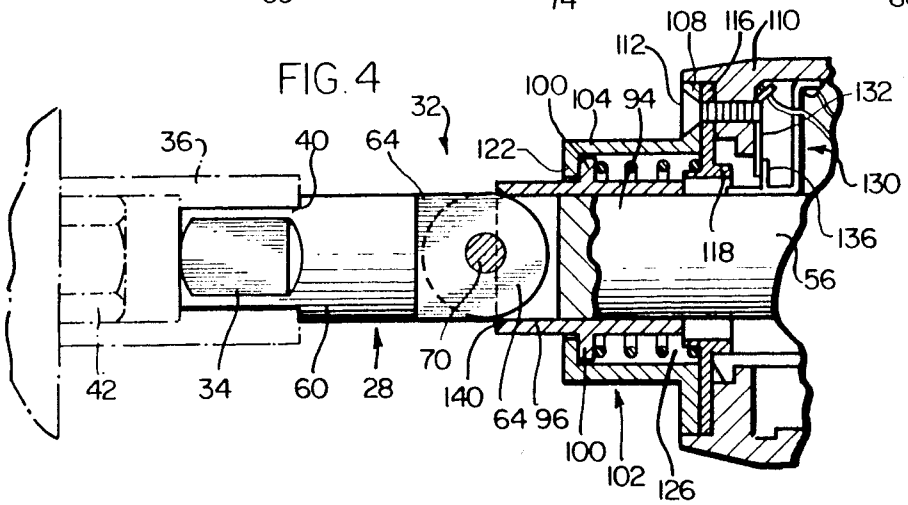
FIG. 4 is an enlarged, fragmentary view of the drive head portion of the driver of FIG. 3 and indicating schematically an internal switch in a closed mode to deliver non-manual driving power to the drive tool.

Referring now to FIGS. 3, 4, and 5, a forward lineal segment 94 of the drive shaft 56 is fitted with a longitudinally slidable sleeve 96 which extends forwardly toward the pivot pin 70 of the pivot assembly 32 (FIG. 4). The sleeve 96 is formed with a radially outwardly projecting annular control ring 100. A sleeve-encircling sheath 102 having a principal annular wall 104 coaxial with and spaced outwardly of the sleeve 96 is secured at an annular plate 108 of the sheath to the wall 104 of the sheath and extending normally of the wall 104 radially outwardly thereof. A threaded bolt 112 secures the plate 108 to the wall 110 of the housing 24. A disc-like radial washer 116 having an integrally formed shoulder 118 projecting normally of the plate 116 is also locked in place by the bolt 112. At its opposide end the sheath 102 is formed with a radially inwardly directed flange 122 which extends toward and terminates proximate of the sleeve 96 forwardly of the control ring 100.

An annular cavity 126 bounded at its front and rear by the control ring 100 and the plate 116 and above and below by the annular wall 104 and the sleeve 96 houses and confines a coil spring 124. The spring 124 is in compression and biases the sleeve 96 forwardly by expansion force applied against the control ring 100 (FIG. 4).

Referring now to FIGS. 4 and 5, the manner in which electrical power is disconnected from the drive shaft 56 when it is desired to use the driver tool 20 in a manual mode (FIG. 5) rather than in a non-manual power mode (FIG. 4) is shown. A safety switch 130 having contact elements 132 and 136 is located within the housing 24 in a zone rearwardly of the sleeve 96 and the sheath 102. In the embodiment of the invention illustrated, the contact element 132 is fixed in position and the contact element 136 is movable but is biased into contact with switch element 132 (FIG. 4), in a configuration to deliver electrical power to the drive shaft 56 to energize the drive shaft 56, provided that the digitally operated slide switch 90 is in an operational setting ("F" or "R"). It will be appreciated that in the physical configuration represented by FIG. 4, the drive shaft 56 of the tool 20 and the rotational shaft of the tool drive head 28 are coaxial, for non-manual power operation of the tool 20.

FIG. 5 shows the drive head 28 pivoted 90° with respect to the drive shaft 56 of the tool 20. This is the physical orientation when the tool 20 is to be used manually. In this operational mode, electrical power is cut off from the internal drive mechanism of the tool 20. Safety during manual operation is assured.

Referring specifically to FIG. 5, it is shown schematically that as the drive head 28 is pivoted on the pivot joint 32, the arms 48 and 52 or the body 60 of the drive head is brought to bear against, in a camming action, to displace the sleeve 96 longitudinally. (As best seen in FIG. 4, the outwardly-presented inside annular corner of the sleeve 96 is chamfered 140 to ease the camming step.) As the sleeve is forcibly pushed inwardly along the drive shaft 56, it engages a slidable base component 142 of the electrical contact 136 to overcome the bearing force of a z-spring section 146 of spring contact 136 to move switch element 136 away from element 132 to effect an opening of the "switch" 130 (FIG. 5). Electrical power to the drive shaft 56 is cut off. The drive tool may be safely used, manually.

Figure 6:
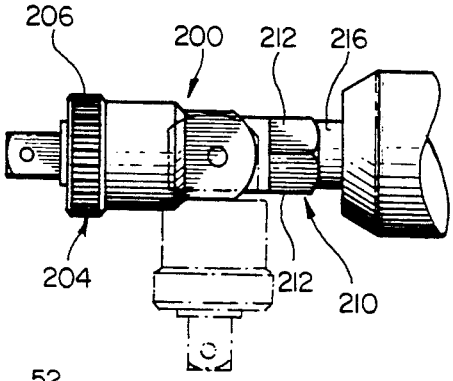
FIG. 6 is a fragmentary view of a second embodiment of the invention in which the drive head includes a ratchet drive mechanism.

The above-detailed description has been with reference to one preferred embodiment of the invention. The fragmentary view of FIG. 6 depicts a modification of the driver tool of the invention in which the drive head 200 includes a ratchet drive assembly 204 with a drive-reversing collar 206. This ratchet feature is especially useful when the drive wrench is used in a manual mode. Any of many ratchet-head drive configurations, well known in the art, may be employed. It will be noted that FIG. 6 also shows the tool as including a drive shaft sector 210 which is formed with parallel faces 212 for accommodating an open-end wrench. This feature provides an ancillary method of imparting significant driving moment to the drive head 200. The procedure would be carried out with the drive shaft 216 and the drive head 204 in essentially coaxial alignment, as shown in the solid lines of FIG. 6.

In a preferred embodiment of the invention the tool 20 includes a recessed electrical connector 220 to which an extension cord (not shown) to be plugged into a line current power supply jack may be connected.

What is claimed is:

1. A drive device operational, optionally and selectively with non-manual power and with manual power, said device comprising coupler means for engaging a tool element forcibly to be rotated, rotatable drive shaft means for reversibly driving said coupler means, selectively, in each of two opposite rotational modes, pivot joint means interposed between said drive shaft means and said coupler means for connecting said drive shaft means to said coupler means, said coupler means being manipulable at said pivot joint means to extend, selectively, coaxially with said drive shaft means and, alternatively, to assume an attitude normal to said drive shaft means, housing means extending coaxially with said drive shaft means for defining handle means for manually gripping and for manipulating said drive device, speed-reducing and power-amplifying means confined in said housing means for regulating rotation of said drive shaft means, non-manual power means for driving said speed-reducing and power-amplifying means, and connector means for coupling said non-manual power means to said drive shaft means, for rotating said drive shaft, in each of two opposite drive directions, said housing means being arcuately manipulable manually, forcibly to rotate said coupler means when said housing means is pivoted at said pivot joint means to extend normally of a rotational axis of said coupler means connected to said drive shaft means, switch means operationally interposed between said non-manual power means and said drive shaft means for selectively connecting power to and for interrupting delivery of power to said drive shaft means, said switch means being closed and functioning to effect delivery of power to said drive shaft means when said drive shaft means extends coaxially with said coupler means, and interrupter means for opening said switch means to cut off power to said drive shaft means when said coupler means is pivotally oriented to extend normally of a rotational axis of said drive shaft means.

2. The structure as set forth in claim 1 wherein said non-manual power means comprises electrical motor means, for driving said speed-reducing and power-amplifying means, and further comprising ON-OFF switch means for controlling delivery of electrical power to said electrical motor means.

3. The structure as set forth in claim 2 and further comprising battery means for energizing said electrical motor means.

4. The structure as set forth in claim 2 and further comprising means connecting said motor means to a line current supply for energizing said motor means.

5. The structure as set forth in claim 1 wherein said coupler means is oriented to extend normally of said drive shaft means and normally of said housing means, and wherein said housing means constitutes gripping-handle means for manually drivingly rotating said coupler means and for facilitating application of high torque forces to said coupler means and to any tool element connected thereto.

6. The structure as set forth in claim 1 and further comprising a lineal portion of said drive shaft means extending from said housing means toward said pivot joint means, said lineal portion defining in a zone proximal to said pivot joint means a neck of non-circular cross section and including a pair of parallel surfaces for positioning of a tool thereon for imposing rotational mechanical torque manually to said drive shaft means and to said coupler means connected thereto.

7. A drive device as set forth in claim 1 and further comprising ratchet head means interposed functionally between said pivot joint means and said coupler means for facilitating rotation of said coupler means, selectively, in each of two opposed annular directions.

8. In a device for rotatively driving a tool element and including coupler means for engaging a tool element forcibly to be rotated, drive shaft means for reversibly driving said coupler means, selectively, in each of two opposite rotational modes, pivot joint means interposed between said drive-shaft means and said coupler means for connecting said drive shaft means to said coupler means, non-manual power means for driving said drive shaft means, speed-reducing and power-amplifying means for regulating rotation of said drive shaft means, on-off switch means for delivery of non-manual power from said non-manual power means to said speed-reducing and power-amplifying means, and housing means extending coaxially with said drive shaft means for manually gripping and manually manipulating said device, the improvement wherein said pivot joint means is articulatable between a non-manual drive mode in which said coupler means and said drive shaft means are disposed in a coaxial configuration in which said coupler means can be energized non-manually, and in a manual power configuration in which said coupler means and any rotatable tool connected thereto extend in a direction normally of a longitudinal axis said drive shaft, for optional manual operation of said device, wherein said device further comprises safety switch means interposed operationally between said non-manual power means and said drive shaft means for selectively connecting non-manual power to and for interrupting delivery of non-manual power to said drive shaft means, wherein said safety switch means is closed when said pivot joint means is in a non-manual power supply mode with said coupler means and said drive shaft means being in a coaxial configuration, and wherein articulation of said pivot joint means to position said coupler means to extend normally of said drive shaft means for driving said device manually is operative physically to open said safety switch means to cut off non-manual power to said drive shaft means of said device, thereby to protect an operator of the device during manual use thereof.

* * * * *